US009498030B2

(12) United States Patent
Ma

(10) Patent No.: US 9,498,030 B2
(45) Date of Patent: Nov. 22, 2016

(54) UMBRELLA QUICK FRAME ASSEMBLY SYSTEMS AND METHODS

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 13/797,477

(22) Filed: Mar. 12, 2013

(65) Prior Publication Data

US 2013/0276843 A1 Oct. 24, 2013

(30) Foreign Application Priority Data

Apr. 19, 2012 (CN) ..... 2012 1 0116279

(51) Int. Cl.
*A45B 25/06* (2006.01)

(52) U.S. Cl.
CPC ..... *A45B 25/06* (2013.01); *Y10T 29/40* (2015.01)

(58) Field of Classification Search
CPC ..... A45B 25/06; A45B 25/08
USPC ..... 135/28–30, 19.5
See application file for complete search history.

(56) References Cited

U.S. PATENT DOCUMENTS

| | | | | |
|---|---|---|---|---|
| 331,231 A | | 11/1885 | Folger | |
| 501,089 A | | 7/1893 | Lichtenstein | |
| 620,815 A | | 3/1899 | Warren | |
| 750,178 A | * | 1/1904 | Fesenfeld | 135/28 |
| 770,704 A | | 9/1904 | Vogel | |
| 847,805 A | * | 3/1907 | McAvoy | 135/30 |
| 878,270 A | * | 2/1908 | Blake et al. | 135/30 |
| 880,534 A | | 3/1908 | Hoyt | |
| 897,026 A | | 8/1908 | Seitzinger | |
| 928,169 A | | 7/1909 | Bardon | |
| 941,952 A | | 11/1909 | Riehl | |
| 947,790 A | | 2/1910 | Carter | |
| 959,127 A | | 5/1910 | Edwards | |
| 1,001,076 A | | 8/1911 | Redford | |

(Continued)

FOREIGN PATENT DOCUMENTS

| | | | | |
|---|---|---|---|---|
| CA | 1269018 | | 5/1990 | |
| DE | 1152226 | * | 8/1963 | A45B 25/06 |

(Continued)

OTHER PUBLICATIONS

Extended European Search Report issued in EP Application No. 14157685, dated Jul. 7, 2014, in 8 pages.

(Continued)

*Primary Examiner* — Noah Chandler Hawk
(74) *Attorney, Agent, or Firm* — Knobbe, Martens, Olson & Bear, LLP

(57) ABSTRACT

An umbrella hub is provided that includes an inner portion, an outer periphery, a lower portion and an upper portion. A plurality of vertical grooves is disposed in the outer periphery and is configured to receive umbrella ribs or struts. A plurality of grooves extends transverse to the vertical grooves. A retention member is disposed in each of the transverse grooves. A first configuration of the hub permits deflection of the retention member such that a transverse pin coupled with the umbrella ribs or struts can be inserted into the transverse groove in which the retention member is disposed. A second configuration of the hub prevents deflection of the retention member such that inadvertent withdrawal of the pin from the transverse groove in which the retention member is disposed is prevented.

21 Claims, 13 Drawing Sheets

(56) References Cited

U.S. PATENT DOCUMENTS

| | | | | | |
|---|---|---|---|---|---|
| 1,022,944 | A | * | 4/1912 | Hodinger | 135/28 |
| 1,078,069 | A | | 11/1913 | Simons | |
| 1,107,415 | A | | 8/1914 | Drohan | |
| 1,264,075 | A | | 4/1918 | Hout | |
| 1,469,495 | A | | 10/1923 | Bunker | |
| 1,808,610 | A | * | 6/1931 | Roy | 135/28 |
| 2,101,510 | A | * | 12/1937 | Rathbun | 135/28 |
| 2,207,043 | A | | 7/1940 | Weiss et al. | |
| 2,321,495 | A | | 6/1943 | Levin | |
| 2,336,116 | A | | 12/1943 | Morando | |
| 2,385,575 | A | | 9/1945 | Isler | |
| 2,469,637 | A | | 5/1949 | Evans et al. | |
| 2,635,616 | A | | 4/1953 | Haydu | |
| 2,762,383 | A | * | 9/1956 | Wittman | 135/28 |
| 2,796,073 | A | | 6/1957 | Wittman | |
| 2,860,647 | A | | 11/1958 | Negri | |
| 2,914,154 | A | | 11/1959 | Russell | |
| 3,177,882 | A | | 4/1965 | Vincent | |
| 3,252,468 | A | | 5/1966 | Militano | |
| 3,330,582 | A | | 7/1967 | Morris | |
| 3,424,180 | A | | 1/1969 | Andolfi | |
| 3,462,179 | A | | 8/1969 | Hinkle | |
| 3,557,809 | A | | 1/1971 | Vazquez et al. | |
| 3,643,673 | A | | 2/1972 | Weber | |
| 3,704,479 | A | | 12/1972 | Whitaker | |
| 4,201,237 | A | | 5/1980 | Watts et al. | |
| 4,368,749 | A | | 1/1983 | Lindler et al. | |
| 4,369,000 | A | | 1/1983 | Egnew | |
| 4,627,210 | A | * | 12/1986 | Beaulieu | 52/646 |
| 4,673,308 | A | | 6/1987 | Reilly | |
| 4,750,509 | A | | 6/1988 | Kim | |
| 4,941,499 | A | | 7/1990 | Pelsue et al. | |
| 4,966,178 | A | | 10/1990 | Eichhorn | |
| D320,111 | S | | 9/1991 | Ma | |
| 5,056,291 | A | | 10/1991 | Leung | |
| 5,069,572 | A | | 12/1991 | Niksic | |
| 5,085,239 | A | | 2/1992 | Chin-Hung et al. | |
| 5,188,137 | A | | 2/1993 | Simonelli | |
| 5,193,566 | A | | 3/1993 | Chen | |
| 5,328,286 | A | | 7/1994 | Lee | |
| 5,433,233 | A | | 7/1995 | Shiran et al. | |
| 5,445,471 | A | | 8/1995 | Wexler et al. | |
| 5,738,129 | A | | 4/1998 | Vogt | |
| 5,740,824 | A | | 4/1998 | Tang | |
| 5,797,613 | A | | 8/1998 | Busby | |
| 5,797,695 | A | | 8/1998 | Prusmack | |
| 5,842,494 | A | | 12/1998 | Wu | |
| 5,911,233 | A | * | 6/1999 | Wu | 135/28 |
| 6,076,540 | A | | 6/2000 | You | |
| 6,095,169 | A | | 8/2000 | Lin et al. | |
| 6,199,572 | B1 | | 3/2001 | Rousselle et al. | |
| 6,311,706 | B1 | | 11/2001 | Sato | |
| 6,314,976 | B1 | | 11/2001 | Clarke | |
| 6,332,657 | B1 | | 12/2001 | Fischer | |
| 6,345,637 | B1 | | 2/2002 | Ko | |
| 6,354,316 | B1 | | 3/2002 | Chen | |
| 6,374,840 | B1 | | 4/2002 | Ma | |
| 6,386,215 | B1 | | 5/2002 | Chang | |
| 6,397,867 | B2 | | 6/2002 | You | |
| 6,604,844 | B2 | | 8/2003 | Hussey | |
| 6,643,889 | B1 | | 11/2003 | Kotlarski | |
| 6,701,946 | B2 | | 3/2004 | You | |
| 6,705,335 | B2 | | 3/2004 | You | |
| 6,758,228 | B1 | | 7/2004 | You | |
| 6,814,093 | B2 | | 11/2004 | You | |
| 7,178,535 | B2 | | 2/2007 | Eder | |
| 7,464,503 | B2 | | 12/2008 | Hoberman | |
| 7,481,235 | B2 | | 1/2009 | Prusmack | |
| 7,574,777 | B1 | | 8/2009 | Fuller et al. | |
| 7,703,464 | B2 | | 4/2010 | Ma | |
| 7,891,367 | B2 | | 2/2011 | Ma | |
| 8,061,375 | B2 | | 11/2011 | Ma | |
| 8,069,872 | B2 | | 12/2011 | Bae | |
| 8,082,935 | B2 | | 12/2011 | Ma | |
| 8,082,937 | B2 | | 12/2011 | Tarter et al. | |
| 8,166,986 | B2 | | 5/2012 | Ma | |
| 8,360,085 | B2 | | 1/2013 | Lee | |
| 8,485,208 | B2 | | 7/2013 | Seo | |
| 8,496,019 | B2 | | 7/2013 | Zhou | |
| 2001/0007260 | A1 | | 7/2001 | Rousselle et al. | |
| 2004/0123891 | A1 | | 7/2004 | Ma | |
| 2005/0115599 | A1 | | 6/2005 | You | |
| 2006/0124160 | A1 | | 6/2006 | Lee | |
| 2007/0172310 | A1 | | 7/2007 | Yang et al. | |
| 2009/0126769 | A1 | | 5/2009 | Hoogendoorn | |
| 2009/0260664 | A1 | | 10/2009 | Ma | |
| 2011/0017249 | A1 | | 1/2011 | Ma | |
| 2012/0318316 | A1 | | 12/2012 | Choi et al. | |
| 2013/0008478 | A1 | | 1/2013 | Prieto | |

FOREIGN PATENT DOCUMENTS

| | | | | | |
|---|---|---|---|---|---|
| EP | 0202769 | B1 | * | 12/1989 | A45B 25/06 |
| FR | 855628 | A | * | 5/1940 | A45B 25/06 |
| FR | 002650491 | | | 2/1991 | |
| FR | 2857835 | A1 | * | 1/2005 | A45B 25/06 |
| GB | 2113543 | | | 8/1983 | |
| GB | 2165448 | A | * | 4/1986 | A45B 25/02 |
| JP | 61131921 | | | 8/1986 | |
| KR | 100851744 | | | 8/2008 | |
| WO | WO 2005/023042 | | | 3/2005 | |

OTHER PUBLICATIONS

Extended European Search Report issued in EP Application No. 14158057, dated Jul. 7, 2014, in 7 pages.

U.S. Appl. No. 13/783,375, filed Mar. 4, 2013, Ma, and its prosecution history.

U.S. Appl. No. 13/787,601, filed Mar. 6, 2013, Ma, and its prosecution history.

U.S. Appl. No. 14/189,822, filed Feb. 25, 2014, Ma, and its prosecution history.

EPO Extended Search Report dated Apr. 5, 2011 for European Patent No. 09252140.0, filed Sep. 7, 2009.

Treasure Garden, 2010 Products Catalog, pp. 20 and 60.

Extended European Search Report issued in EP Application No. 15156587.6, dated Jul. 23, 2015, in 7 pages.

* cited by examiner

UMBRELLA QUICK FRAME ASSEMBLY SYSTEMS AND METHODS

CROSS-REFERENCE TO RELATED APPLICATIONS

This application claims the benefit of Chinese Patent Application No. 201210116279.0, filed Apr. 19, 2012, the entirety of which is hereby incorporated by reference for all purposes.

BACKGROUND OF THE INVENTION

1. Field of the Invention

This invention involves the technical aspects of an umbrella, especially the technical aspects of the upper and lower runners, sometimes referred to herein as hubs, of an umbrella. It specifically refers to the upper and lower runners of a quick frame assembly system and the relevant umbrella and the quick frame assembly method.

2. Description of the Related Art

An earlier frame assembly method for attaching the ribs to the upper and lower runners of an umbrella frame is: The upper and lower runners are provided with annular grooves and the ribs have through holes. Iron wires are inserted into the through holes of multiple ribs and are tightly wound in the annular grooves. Tools are required to carry out the assembly and the protruding ends of the wire could injure a user or assembler. The umbrella is difficult to assemble and requires extra care.

The current frame assembly method is: the two sides of one end of the umbrella ribs have lugs and the upper and lower runners are both divided into the hollow runner body and base. There are several U-shaped slots around the outer periphery of the hollow runner body. The two lugs on the rib are respectively situated in the two U-shaped slots. The base is fitted into the hollow runner body to seal up the U-shaped slots. The hollow runner body is provided with fasteners, i.e. for areas that can be fastened, and the fasteners pierce into the base and become secured.

SUMMARY OF THE INVENTIONS

These inventions herein hope to provide another type of quick frame assembly system with upper and lower runners, and where no fixtures, tools or screws are required for the frame assembly. The assembly is quick, easy and flexible, and the ribs can either be assembled vertically or horizontally.

Some of the objectives of these inventions are to address the shortcomings of the prior technology mentioned above by providing the upper and lower runners of a quick frame assembly system and the relevant umbrella frame and the quick frame assembly method. The upper and lower runners are cleverly designed and structurally simple. No fixtures, tools or screws are required for the frame assembly. The assembly is quick, easy and flexible, and the ribs can either be assembled vertically or horizontally. It is also suitable for large-scale application.

In order to achieve the aforementioned objective, the first aspect of this invention provides an upper runner of a quick frame assembly system comprising an upper runner cover and an upper runner base, wherein several upper runner rib hitching grooves or coupling grooves are disposed around the circumference of the outer periphery of the upper runner cover. A first upper runner vertical groove is located between the upper runner rib hitching grooves. The upper runner base has several upper runner stop blocks or retention members. A second upper runner vertical groove is located on the outer periphery of the upper runner base. The first vertical groove 1 is aligned with the second vertical groove. The upper runner cover and the upper runner base should be able to fit into each other and become mutually fastened at positions 1 and 2. At position 1, the upper runner stop block is set into the respective upper runner rib hitching groove and seals up blocks, or encloses a portion of the upper runner rib hitching groove. At position 2, the upper runner stop block is set into the respective upper runner rib hitching groove and seals up, blocks, or encloses all of the upper runner rib hitching groove.

Preferably, the upper runner cover has a first upper runner inverted fastening unit and a second upper runner inverted groove. The upper runner base should have a first upper runner inverted groove and a second upper runner inverted fastening unit. At position 1, the first upper runner inverted fastening unit is fastened to the first upper runner inverted groove. At position 2, the second upper runner inverted fastening unit is fastened to the second upper runner inverted groove.

More preferably, there should be at least two (2) of the first upper runner inverted fastening units. The first upper runner inverted fastening units should be symmetrical with respect to the axis of the corresponding upper runner cover. There should be at least two (2) of the first upper runner inverted grooves. The first upper runner inverted fastening grooves should be symmetrical with respect to the axis of the corresponding upper runner base.

More preferably, there should be at least two (2) of the second upper runner inverted grooves. The second upper runner inverted grooves should be symmetrical with respect to the axis of the corresponding upper runner cover. There should be at least two (2) of the second upper runner inverted fastening units. The second upper runner inverted fastening units should be symmetrical with respect to the axis of the corresponding upper runner base.

Preferably, the center of the said upper runner cover has a hollow sleeve and the upper runner base is fitted into or over the said hollow sleeve.

More preferably, the lower section of the hollow sleeve is provided with positioning holes.

The second aspect of this invention provided a lower runner of a quick frame assembly system comprising a lower runner cover and a lower runner base, wherein several lower runner rib hitching grooves or coupling grooves are disposed around the circumference of the outer periphery of the said lower runner cover. A first lower runner vertical groove is located between the lower runner rib hitching grooves. The said lower runner base has several lower runner stop blocks or retention member. A second lower runner vertical groove is located on the outer periphery of the said lower runner base. The first vertical groove is aligned with the second vertical groove. The lower runner cover and the lower runner base should be able to fit into each other and be mutually fastened at first and second positions. At the first position, the lower runner stop block is set into the respective lower runner rib hitching groove and seals up, blocks, or encloses a portion of the lower runner rib hitching groove. In this context and as similarly discussed herein "seals up" and "encloses" can include a condition where the stop block partially blocks access to or egress from the hitching groove. As discussed further below in this position, the stop block is permitted to flex sufficiently to permit pins attached to ribs to be inserted into the hitching grooves. At the second position, the lower runner stop block is set into the respective lower runner rib hitching groove and seals up all of or completely encloses all of the lower runner rib hitching groove. In this context and as similarly discussed herein "seals up all" and "completely encloses" can include a condition where the stop block fully blocks access to or egress from the hitching or coupling groove. As discussed further below in this position, the stop block is braced so that it does not permit ribs or pins coupled with ribs to be inadvertently withdrawn from the hitching grooves.

Preferably, the lower runner cover has a first lower runner inverted fastening unit and a second lower runner inverted groove. The lower runner base should have a first lower runner inverted groove and a second lower runner inverted fastening unit. At the first fastening position, the first lower runner inverted fastening unit is fastened to the first lower runner inverted groove. At the second fastening position, the second lower runner inverted fastening unit is fastened to the second lower runner inverted groove.

More preferably, there should be at least two (2) of the first lower runner Inverted Fastening Units. The first lower runner Inverted Fastening Units should be symmetrical with respect to the axis of the corresponding lower runner cover. There should be at least two (2) of the first lower runner Inverted Grooves. The first lower runner inverted grooves should be symmetrical with respect to the axis of the said corresponding lower runner base.

More preferably, there should be at least two (2) of the second lower runner inverted fastening units. The second lower runner inverted fastening units should be symmetrical with respect to the axis of the corresponding lower runner cover. There should be at least two (2) of the second lower runner inverted grooves. The second lower runner inverted grooves should be symmetrical with respect to the axis of the said corresponding lower runner base.

Preferably, the lower runner cover has a first center hole. The lower runner cover also preferably has a third lower runner inverted fastening unit. The third lower runner inverted fastening unit can be located at an extension of the edge of the first center hole. The lower runner base should have a second center hole. The second center hole can have a third lower runner inverted groove. At the second fastening position, the third lower runner inverted fastening unit can be fastened to the third lower runner inverted groove.

More preferably, there should be at least two (2) of the third lower runner inverted fastening units. The third lower runner inverted fastening units can be symmetrical with respect to the axis of the corresponding lower runner cover. There should be at least two (2) of the third lower runner inverted grooves. The third lower runner inverted grooves can be symmetrical with respect to the axis of the corresponding lower runner base.

The third aspect of this invention provides an umbrella frame comprising first ribs and a shaft. One end of the first ribs has first shaft pins. The umbrella further comprises any of the upper runner embodiments discussed in this application. The upper runner is installed on the shaft. The upper runner cover and the upper runner base mutually come together at the second position. One end of the first ribs is situated in the first upper runner vertical groove. The two ends of the shaft pins 1 are situated in the two adjacent upper runner rib hitching grooves. The shaft pins 1 are immobilized by the upper runner stop blocks situated in the upper runner rib hitching grooves. In this context, "immobilized" means retained or prevented from being withdrawn inadvertently, but permitting at least rotational movement so that the ribs can swing through typical range of motion for opening and closing the umbrella.

Preferably, the center of the upper runner cover has a hollow sleeve. The upper runner base is inserted into or is advanced over the hollow sleeve and the hollow sleeve is set into the shaft. The upper runner base is held up against the shaft.

More preferably, the lower section of the hollow sleeve is provided with one or more positioning holes and the shaft is provided with fastener holes. The positioning holes and the fastener holes are connected with fasteners.

The fourth aspect of this invention provided an umbrella frame comprising of second ribs and a shaft. One end of the second ribs has second shaft pins. The umbrella further comprises any of the embodiments of the lower runner of a quick frame assembly system as discussed herein. The lower runner is mounted and slides on the shaft. The lower runner cover and the lower runner base mutually come together at the second position. One end of the second ribs is situated in the first lower runner vertical groove, and the two ends of the second shaft pins are situated in the two adjacent lower runner rib hitching grooves and are immobilized with the lower runner stop blocks situated in the lower runner rib hitching grooves. As discussed above, "immobilized" here means retained or prevented from being withdrawn inadvertently, but permitting at least rotational movement so that the ribs can swing through typical range of motion for opening and closing the umbrella.

Preferably, the lower runner cover has a first center hole, and The lower runner cover preferably also has a third lower runner inverted fastening unit that can be located at an extension of the edge of the first center hole. The lower runner base should have a second center hole. The second center hole preferably has a third lower runner inverted groove. The third lower runner inverted fastening unit can be fastened to the third lower runner inverted groove. The shaft goes through the first center hole 1 and the second center hole and is secured with the third lower runner inverted fastening unit.

The fifth aspect of this invention provides an umbrella frame comprising first ribs, second ribs, and a shaft. One end of the first ribs has first shaft pins. One end of the second ribs has second shaft pins. The other end of the second ribs is swivel-connected to a central portion of the first ribs. The umbrella further comprises any of the upper runners and any of the lower runners of a quick frame assembly system described herein. The upper runner is installed on the shaft. The upper runner cover and the upper runner base mutually come together at the second position. One end of the first ribs is situated in the upper runner vertical groove 1 and the two ends of the first shaft pins are situated in the two adjacent upper runner rib hitching grooves. The two ends of the first shaft pins are immobilized by the said upper runner stop blocks situated in the upper runner rib hitching grooves. "Immobilized" has the broad meaning discussed above in this regard. The lower runner is mounted and slides on the shaft and is situated below the upper runner. The lower runner cover and the lower runner base mutually come together at the second position. One end of the second ribs is situated in the lower runner vertical groove 1, and the two ends of the second shaft pins are situated in the two adjacent lower runner rib hitching grooves. The second shaft pins are immobilized by the lower runner stop blocks situated in the lower runner rib hitching grooves. "Immobilized" has the broad meaning discussed above in this regard.

The sixth aspect of this invention provides a quick frame assembly method realized using the abovementioned upper runner of a quick frame assembly system, wherein includes any combination or all of the following steps:

(1) The upper runner cover and the upper runner base are fitted together to cause the upper runner cover and the upper runner base to become mutually attached at the first position, thereby the upper runner stop block is respectively inserted into the upper runner rib hitching groove in a manner that seals up a portion of (e.g., partially blocks or encloses) the upper runner rib hitching groove;

(2) One end of the first rib is inserted into the upper runner vertical groove 1 and the two ends of the first shaft pins installed at one end of the first ribs are respectively positioned in the two adjacent upper runner rib hitching grooves, with further advancement of the first ribs causing the first shaft pins to press against the upper runner stop block. At least a portion of the upper runner stop block will exit (e.g., be deflected away or at least partially out of) the upper runner rib hitching groove as a result of the elastic deformation of the upper runner stop block or the elastic deformation of the upper runner cover and/or the upper runner base, and thus the first shaft pins are able to enter the upper runner rib hitching grooves. Thereafter, the upper runner stop block returns to its original position to immobilize the first shaft pins;

(3) The upper runner cover and the upper runner base move closer to each other to allow the upper runner cover and the upper runner base to become mutually attached at the second position, thereby the upper runner stop block moves further into the upper runner rib hitching groove and in turn seals up the entire upper runner rib hitching groove to firmly immobilize the shaft pins 1. "Seals up" and "immobilize" have the broad meaning discussed elsewhere herein.

Preferably, the upper runner cover should have a first upper runner inverted fastening unit and the upper runner base should have a first upper runner inverted groove. In the step (1), the upper runner cover and the upper runner base should be able to become mutually attached at the first position through the attaching of the first upper runner inverted fastening unit to the first upper runner inverted groove.

Preferably, the upper runner cover should have a second upper runner inverted groove and the upper runner base should have a second upper runner inverted fastening unit. In the step (3), the upper runner cover and the upper runner base should be able to become mutually attached at the second position through the attaching of the second upper runner inverted fastening unit to the second upper runner inverted groove.

The seventh aspect of this invention provides a quick frame assembly method realized using any of the above-mentioned lower runners of a quick frame assembly system, wherein the method includes any combination or all of the following steps:

(A) The lower runner cover and the lower runner base are fitted together to cause the lower runner cover and the lower runner base to be able to mutually come together at the first fastening position, thereby the lower runner stop block is respectively inserted into the lower runner rib hitching groove and this seals up a portion of (as broadly defined herein) the lower runner rib hitching groove;

(B) One end of the second rib is inserted into the lower runner vertical groove 1 and the two ends of the second shaft pins, installed at one end of the second ribs, are respectively positioned in the two adjacent lower runner rib hitching grooves, with further advancement of the second ribs causing the shaft pins 2 to press against the lower runner stop block. At least a portion of the lower runner stop block will exit (e.g., be deflect away or at least partially out of) the lower runner rib hitching groove as a result of the elastic deformation of the lower runner stop block or the elastic deformation of the lower runner cover and/or the lower runner base. The second shaft pins are then able to enter the lower runner rib hitching grooves. Thereafter, the lower runner stop block returns to its original position to immobilize (as broadly defined herein) the second shaft pins;

(C) The lower runner cover and the lower runner base move closer to each other to allow the lower runner cover and the lower runner base to become mutually attached at the second position, thereby the lower runner stop block moves further into the lower runner rib hitching groove and this in turn seals up the entire (as broadly defined herein) lower runner rib hitching groove to firmly immobilize the second shaft pins.

Preferably, the lower runner cover should have a first lower runner inverted fastening unit and the lower runner base should have a first lower runner inverted groove. In step (A), the lower runner cover and the lower runner base should be able to become mutually attached at the first fastening position through the attaching of the first lower runner inverted fastening unit to the first lower runner inverted groove.

Preferably, the lower runner cover should have a second lower runner inverted groove and the lower runner base should have a second lower runner inverted fastening unit. In step (C), the lower runner cover and the lower runner base should be able to become mutually attached at the second fastening position through the attaching of the second lower runner inverted fastening unit to the second lower runner inverted groove.

Some of the specific benefits resulting from these inventions are:

1. The upper runner of various embodiments of this invention comprises an upper runner cover and an upper runner base. Several upper runner rib hitching grooves are created around the circumference of the outer periphery of the upper runner cover. A first upper runner vertical groove is located between the upper runner rib hitching grooves. The upper runner base has several upper runner stop blocks, and the second upper runner vertical groove is located on the outer periphery of the upper runner base. The first vertical groove is aligned with the second vertical groove, and the upper runner cover and the upper runner base should be able to fit into each other and become mutually attached at first and second positions. At the first position, the upper runner stop block is set into the respective upper runner rib hitching groove and seals up a portion (as broadly defined herein) of the upper runner rib hitching groove. At the second position, the upper runner stop block is set into the respective upper runner rib hitching groove and seals up the entire (as broadly defined herein) upper runner rib hitching grooves. After the upper runner cover and the upper runner base are thus fastened at the first position, elastic deformation is utilized to push the shaft pin on the rib to go beyond the upper runner stop block to enter into the upper runner rib hitching groove and it is then immobilized (as broadly defined herein) by the upper runner stop block. Thereafter, the upper runner cover and the upper runner base should come together at the second position, and the upper runner stop block moves further into the upper runner rib hitching groove to completely seal up (as broadly defined herein) the upper runner rib hitching groove, thereby completing the assembly of the rib with the upper runner in some embodiments. These inventions are cleverly designed and structurally simple. No fixtures, tools or screws are required for the rib assembly. The assembly is quick, easy and flexible, and the ribs can either be assembled vertically or horizontally. It is also suitable for large-scale application.

2. The lower runner of this invention comprises a lower runner cover and a lower runner base. Several lower runner rib hitching grooves are created around the circumference of the outer periphery of the lower runner cover. A first lower runner vertical groove is located between the lower runner rib hitching grooves. The lower runner base has several lower runner stop blocks. A second lower runner vertical groove is located on the outer periphery of the lower runner base. The first vertical groove is aligned with the second vertical groove, and the lower runner cover and the lower runner base should be able to fit into each other and become mutually fastened at the first and second positions. At the first position, the upper runner stop block is set into the respective upper runner rib hitching groove and seals up a portion of (as broadly defined herein) the lower runner rib hitching groove. At the second position, the lower runner stop block is set into the respective lower runner rib hitching groove and seals up the entire (as broadly defined herein) lower runner rib hitching groove. After the lower runner cover and the lower runner base are thus fastened at the first position, elastic deformation is utilized to push the shaft pin on the rib beyond the lower runner stop block to enter into the lower runner rib hitching groove. The shaft pin is then immobilized (as broadly defined herein) by the lower runner stop block. Thereafter, the lower runner cover and the lower runner base should come together at the second position, and the lower runner stop block moves further into the lower runner rib hitching groove to completely seal up (as broadly defined herein) the lower runner rib hitching groove, thereby completing the assembly of the rib in some embodiments. This invention is cleverly designed and structurally simple. No fixtures, tools or screws are required for the rib assembly. The assembly is quick, easy and flexible, and the ribs can either be assembled vertically or horizontally. It is also suitable for large-scale application.

An upper runner of a quick frame assembly system is provided that include an upper runner cover and an upper runner base. The system also includes a plurality of upper runner rib hitching grooves disposed around the circumference of the outer periphery of the upper runner cover. The system also includes a first upper runner vertical groove disposed between the upper runner rib hitching grooves. The upper runner base has several upper runner stop blocks and a second upper runner vertical groove disposed on the outer periphery of the upper runner base. The first upper runner vertical groove is aligned with the second vertical groove. The upper runner cover and the upper runner base are configured to fit together and become mutually fastened at first and second positions. At the first position, the upper runner stop blocks are disposed in the respective upper runner rib hitching grooves and partially blocks the upper runner rib hitching grooves. At the second position, the upper runner stop blocks are disposed in the respective upper runner rib hitching grooves and completely block the upper runner rib hitching grooves.

In another embodiment, an umbrella hub is provided that comprises an inner portion, an outer periphery, a lower portion and an upper portion. The lower portion comprises a lower surface of the hub. The upper portion comprises an upper surface of the hub. A plurality of grooves is disposed in the outer periphery configured to receive umbrella ribs or struts. A plurality of transverse slots is provided, where each slot extends transverse to the grooves. Examples of the slots set forth herein include the hitching grooves discussed below. A retention member is disposed in each of the transverse slots. The hub comprises a first configuration that permits deflection of the retention member such that a transverse pin coupled with the umbrella ribs or struts can be inserted into the transverse slot in which the retention member is disposed. The hub comprises a second configuration that prevents deflection of the retention member such that inadvertent withdrawal of the pin from the transverse groove in which the retention member is disposed is prevented.

In another embodiment, an umbrella hub is provided that includes a hub body, a cavity disposed in the hub body, and a retention member disposed adjacent to the cavity. The hub has a first configuration that permits advancing an umbrella rib retention structure into the cavity and a second configuration. In the second configuration, the retention member prevents removing the umbrella rib retention from the cavity. The hub is actuated between the first and second configurations by moving the retention member. Such movement can be by moving one or both of upper and lower portions of the hub with which the retention member can be integrally formed.

In another embodiment, a quick frame assembly method is provided. In the method, a lower portion of a hub is coupled with an upper portion of the hub. The lower and/or upper portions define a first groove enabling movement of a rib or strut during umbrella operation. The upper and/or lower portions define a plurality of second grooves disposed transversely to the first groove. The retention structures are disposed on at least one of the upper and lower portions. The retention structures extend into the second grooves. One end of a first plurality of ribs is inserted into the first groove and ends of shaft pins of the ribs into the second grooves. The shaft pins are caused to press against the retention structures such that the retention structures are deflected. Deflection of the retention structures permits the shaft pins to be disposed in the second grooves, e.g., between the retention structures and a central axis of the hub. Relative movement is provided between the upper portion and the lower portion. Such movement moves the upper and lower portions of the hub to a position in which deflection of the retention members is prevented.

In another embodiment, an assembly method is provided. In the method, a lower portion of a hub is coupled in a first position with an upper portion thereof. The hub has a cavity. One end a rib is inserted into the hub such that an end of a transverse member of the rib is in the cavity. Relative movement is provided between the upper portion and the lower portion of the hub to block the transverse member from being dislodged from the cavity.

In another embodiment, a lower runner of a quick frame assembly system is provided that includes a lower runner cover and a lower runner base. The system also includes a plurality of lower runner rib hitching grooves disposed around the outer periphery of the lower runner cover. A first lower runner vertical groove is disposed between the lower runner rib hitching grooves. The lower runner base having several lower runner stop blocks and a second lower runner vertical groove disposed on the outer periphery of the said lower runner base. The first lower runner vertical groove is aligned with the second lower runner vertical groove. The lower runner cover and the lower runner base are configured to fit together and be mutually fastened at first and second positions. At the first Position, the lower runner stop blocks are disposed in respective lower runner rib hitching grooves and partially blocks the lower runner rib hitching grooves. At the second position, the lower runner stop blocks are set into the respective lower runner rib hitching grooves and completely block the lower runner rib hitching grooves.

In various combinations, umbrellas are provided that include any of the foregoing hubs or runners of a quick frame assembly systems.

In another embodiment, a quick frame assembly method is provided. In the method, a lower portion of a hub is coupled with an upper portion of a hub for rib assembly. The lower and/or upper portions define a first groove enabling movement of a rib or strut during umbrella operation. The upper and/or lower portions define a plurality of second grooves disposed transversely to the first groove. Retention structures that are disposed on at least one of the upper and lower portions extend into the second grooves. One end of a first plurality of ribs is inserted into the first groove and two pins or two ends of a shaft pin of the ribs are inserted into the second grooves. The shaft pin or ends of pins are pressed against the retention structures such that the retention structures are deflected, e.g. out of the second grooves, to permit further insertion of the pin (s). The deflection can be as a result of the elastic deformation of the retention structure and/or elastic deformation of at least one of the upper portion and the lower portion. The shaft pins or ends of are disposed in the second grooves between the retention structures and the central axis of the hub. The retention structures are permitted to return to an undeflected position to retain the shaft pins or ends. Relative movement is provided between the upper portion and the lower portion to move the upper and lower portions of the hub closer to each other to allow the said upper portion and the lower portion to become fully and mutually attached to prevent deflection of the retention members.

DETAILED DESCRIPTION OF THE PREFERRED EMBODIMENT

Figure 1:
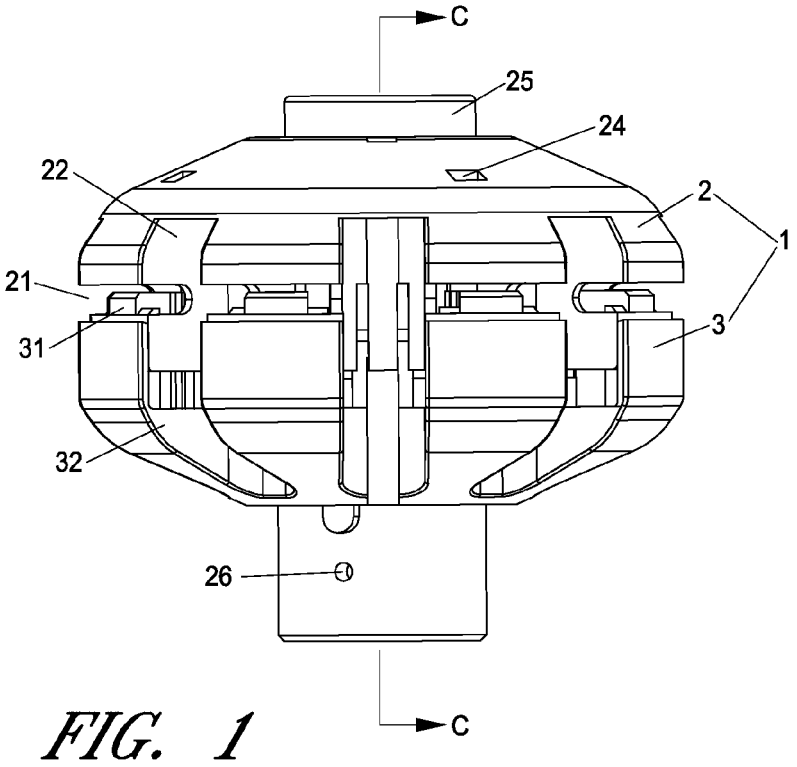
FIG. 1 is a schematic front view of a specific embodiment of the upper runner of this invention in a first fastening position.

In order to be able to understand the technical content of the embodiments more clearly, the following implementations are specially cited and described in detail.

With reference to FIGS. 1-7, an upper runner or hub 1 of this invention comprises an upper hub cover 2 and an upper hub base 3. Several upper hub rib hitching grooves or coupling grooves 21 are created around the circumference of the outer periphery of the upper hub cover 2. A first upper hub vertical groove 22 is located between the upper hub rib hitching grooves 21. The upper hub base 3 has several upper runner stop blocks 31. The stop blocks 31 are examples of retention members within the scope of the embodiments herein. A second upper hub vertical groove 32 is located on the outer periphery of the upper hub base 3. The first upper hub vertical groove 22 is aligned with the second upper hub vertical groove 32. The upper hub cover 2 and the upper hub base 3 should be able to fit into each other and become mutually fastened at positions 1 and 2. At the position 1, the upper hub stop blocks 31 are set into the respective upper hub rib hitching grooves 21 and these partially seal up all of the upper hub rib hitching grooves 21. At the position 2, the upper hub stop blocks 31 are set into the respective upper hub rib hitching grooves 21 and they completely seal up all the upper hub rib hitching grooves 21.

Any suitable structure can be employed to cause the upper hub cover 2 and the upper hub base 3 to become mutually fastened at positions 1 and 2. With reference to FIGS. 1-7, in the specific embodiment of this invention, the upper hub cover 2 has first upper hub inverted fastening units 23 and second upper hub inverted grooves 24. The upper hub base 3 has first upper hub inverted grooves 33 and second upper hub inverted fastening units 34. At the position 1, the first upper hub inverted fastening units 23 are fastened to the first upper hub inverted grooves 33. At the second position, the second upper hub inverted fastening units 34 are fastened to the second upper hub inverted grooves 24.

Figure 2A:
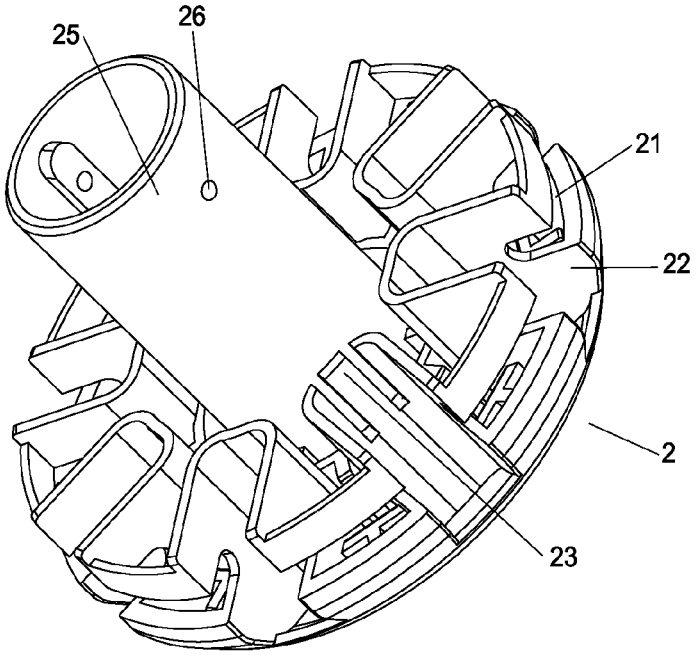
FIG. 2A is a schematic perspective view of a specific embodiment of the upper runner cover shown in FIG. 1.
Figure 2B:
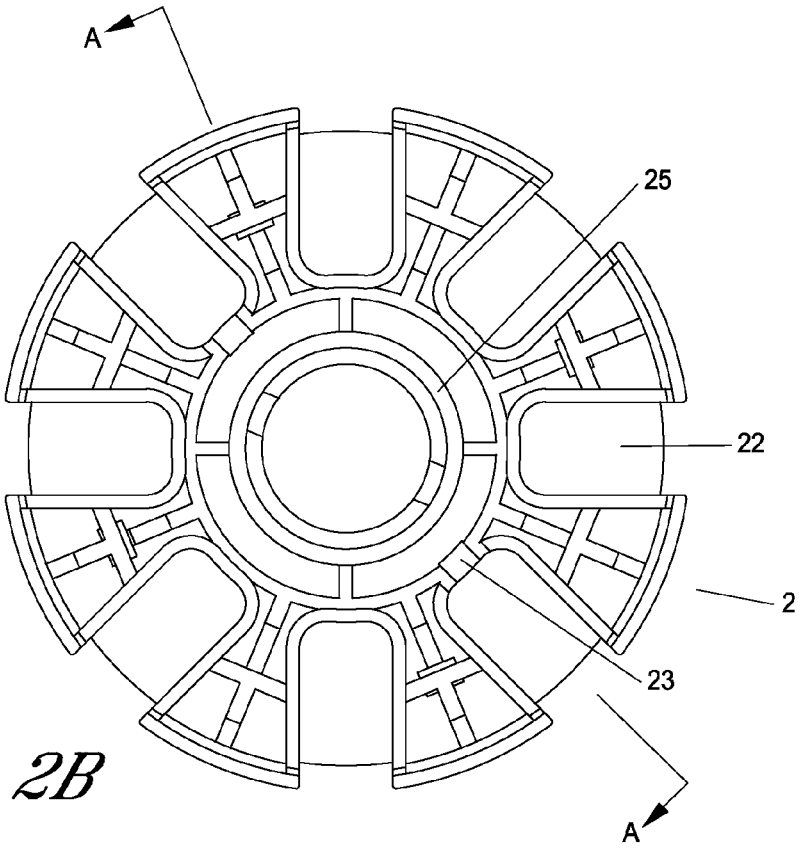
FIG. 2B is a schematic bottom view of a specific embodiment of the upper runner cover shown in FIG. 1.
Figure 3A:
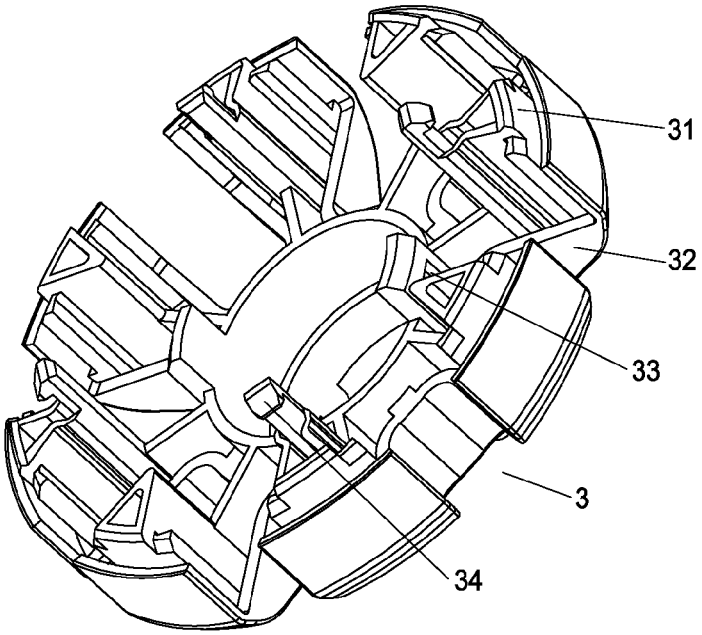
FIG. 3A is a schematic perspective view of a specific embodiment of the upper runner base shown in FIG. 1.

The quantity of the first upper hub inverted fastening units 23 and the upper hub inverted grooves 33 and their installation method can be arbitrarily defined. Preferably, there are at least two of the first upper hub inverted fastening units 23 that are symmetrical with respect to the axis of the corresponding upper hub cover 2. Preferably, there are at least two of the first upper hub inverted grooves 33 that are symmetrical with respect to the axis of the corresponding upper hub base 3. With reference to FIGS. 2B and 3A, in the specific embodiment of this invention, the quantity of the first upper hub inverted fastening units 23 and the first upper hub inverted grooves 33 is two.

Figure 3B:
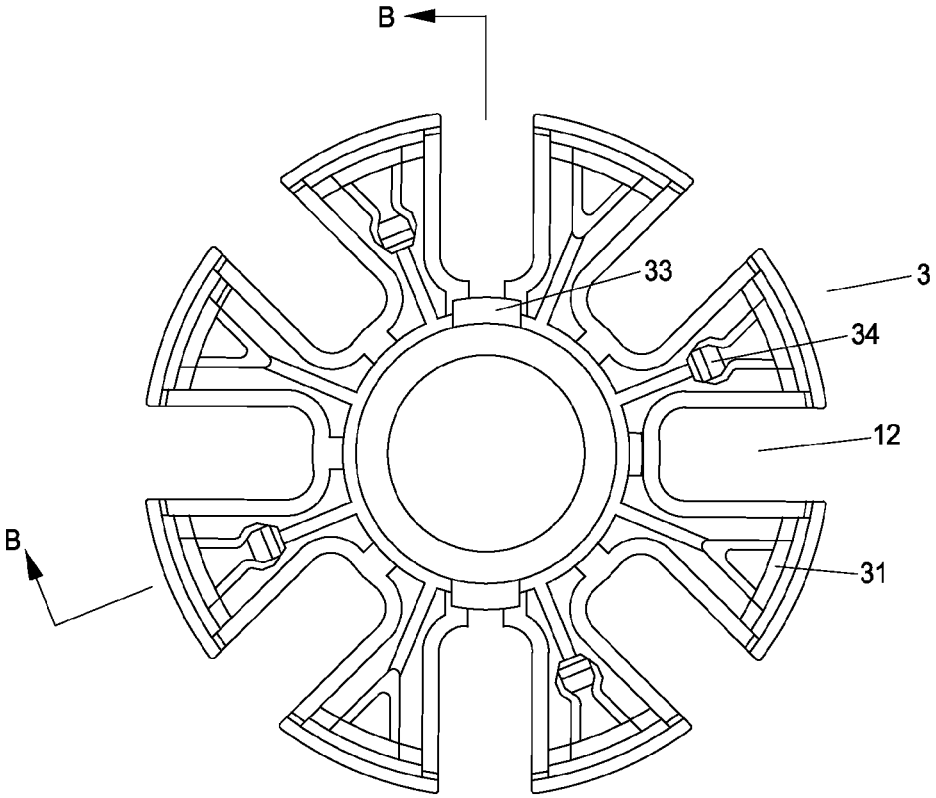
FIG. 3B is a schematic top view of a specific embodiment of the upper runner cover shown in FIG. 1.
Figure 3C:
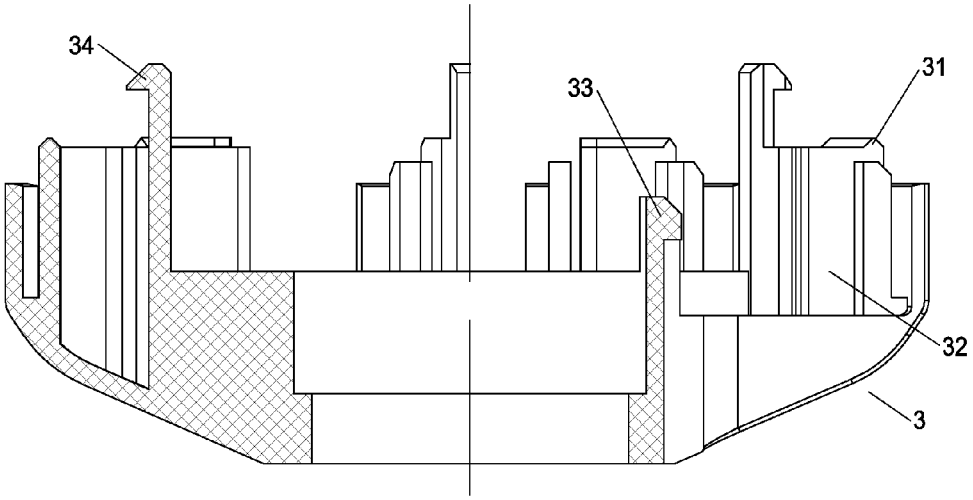
FIG. 3C is a schematic sectional view taken through section plane B-B in FIG. 3B.
Figure 5:
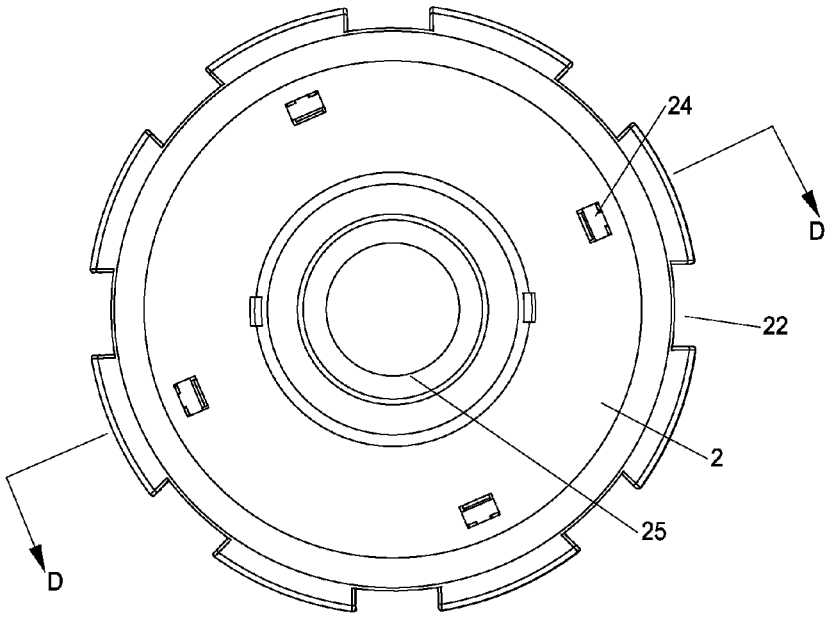
FIG. 5 is a schematic top view of a specific embodiment shown in FIG. 1.

The quantity of the second upper hub inverted fastening units 34 and the second upper hub inverted grooves 24 and their installation method can be arbitrarily defined. More preferably, there should be at least two of the second upper hub inverted grooves 24 and that are symmetrical with respect to the axis of the said corresponding upper hub cover 2. There also should be at least two of the second upper hub inverted fastening units. The second upper hub inverted fastening units preferably are symmetrical with respect to the axis of the said corresponding upper hub base 3. With reference to FIGS. 3A, 3B and 5, in the specific embodiment of this invention, the quantity of the second upper hub inverted fastening units 34 and the second upper hub inverted grooves 2 24 is four.

Figure 2C:
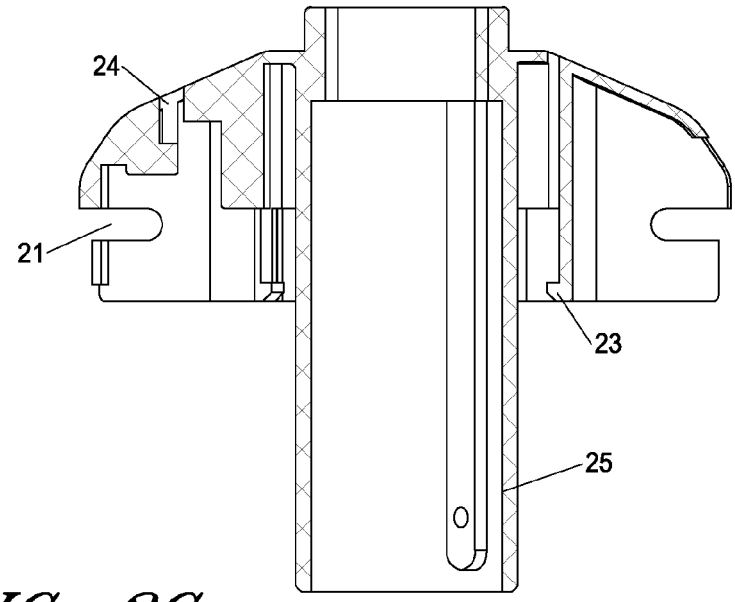
FIG. 2C is a schematic sectional view taken through section plane A-A in FIG. 2B.

Any suitable structure can be employed to install the upper hub 1 on the shaft 10. With reference to FIGS. 1-2C, in the specific embodiment of this invention, the center of the said upper hub cover 2 has a hollow sleeve 25 and the upper hub base 3 is fitted over the hollow sleeve 25. The upper hub 1 is installed on the shaft 10 by means of the hollow sleeve 25.

Any suitable structure can be employed to install the upper hub 1 on the shaft 10 by means of the hollow sleeve 25. With reference to FIGS. 1 and 2A, in various embodiments of this invention, the lower section of the hollow sleeve 25 is provided with positioning holes 26. The upper hub 1 is installed on the shaft 10 by means of the positioning holes 26.

With reference to FIGS. 8-12, the lower runner 4 comprises a lower runner cover 5 and a lower runner base 6. Several lower runner rib hitching grooves or coupling grooves 51 are created around the circumference of the outer periphery of the lower runner cover 5. A first lower runner vertical groove 52 is located between the lower runner rib hitching grooves 51. The lower runner base 6 has several lower runner stop blocks, or retention members 61. A second lower runner vertical groove 62 is located on the outer periphery of the lower runner base 6. The first vertical groove 52 is aligned with the second vertical groove 62, and the lower runner cover 5 and the lower runner base 6 should be able to fit into each other and be mutually attached at positions 1 and 2. At position 1, the lower runner stop blocks 61 are set into the respective lower runner rib hitching grooves 51 and partially seal up (as broadly defined herein) all the lower runner rib hitching grooves 51. At position 2, the lower runner stop blocks 61 are set into the respective lower runner rib hitching grooves 51 and completely seal up (as broadly defined herein) all the lower runner rib hitching grooves 51.

Any suitable structure can be employed to cause the lower runner cover 5 and the lower runner base 6 to become mutually fastened at positions 1 and 2. With reference to FIGS. 8-12, in specific embodiments, the lower runner cover 5 has first lower runner inverted fastening units 53 and second lower runner inverted grooves 54), and the lower runner base 6 has first lower runner inverted grooves 63 and second lower runner inverted fastening units 64. At position 1, the first lower runner inverted fastening units 53 are fastened to the first lower runner inverted grooves 63. At position 2, the second lower runner inverted fastening units 64 are fastened to the second lower runner inverted grooves 54.

Figure 9A:
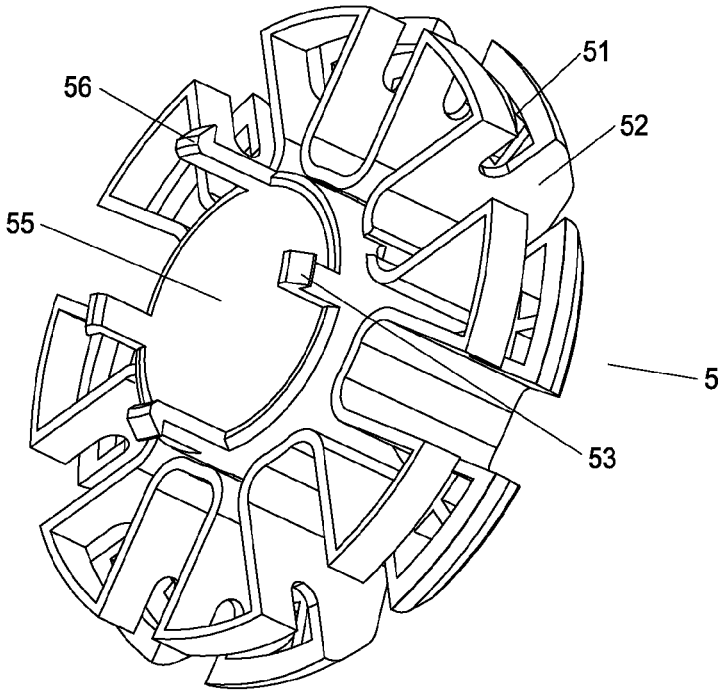
FIG. 9A is a schematic perspective view of a specific embodiment of the lower runner cover shown in FIG. 8.
Figure 9B:
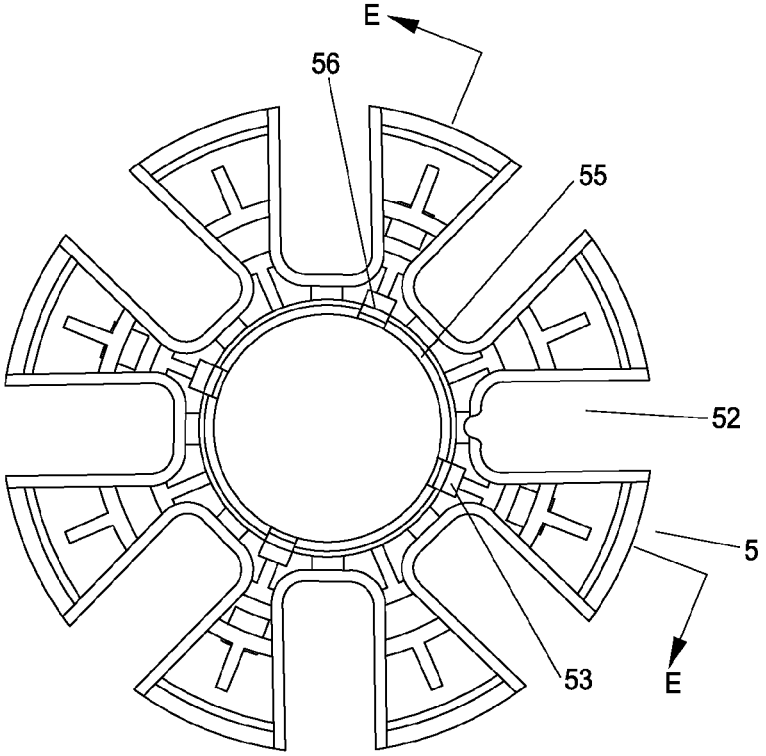
FIG. 9B is a schematic top view of a specific embodiment of the lower runner cover shown in FIG. 8.
Figure 9C:
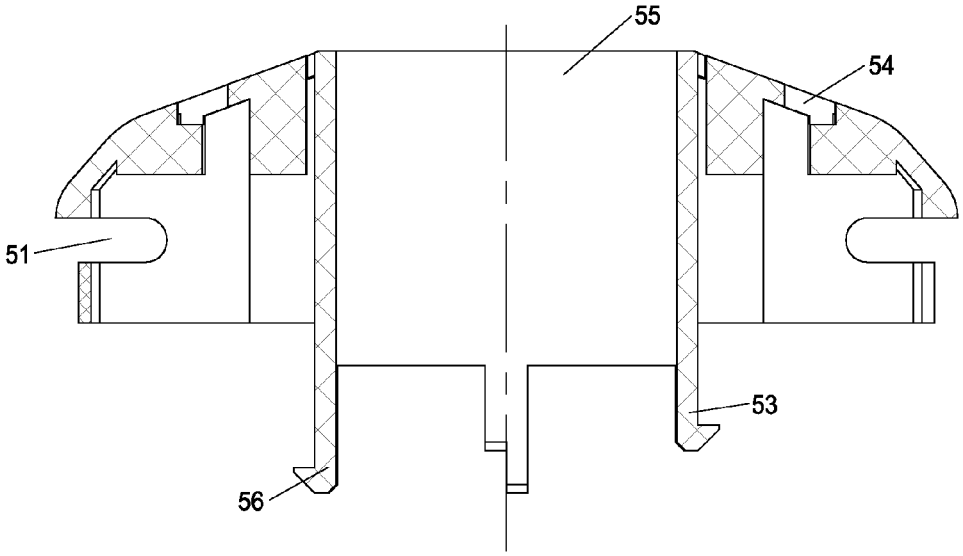
FIG. 9C is a schematic sectional view of taken through section plane E-E in FIG. 9B.
Figure 11:
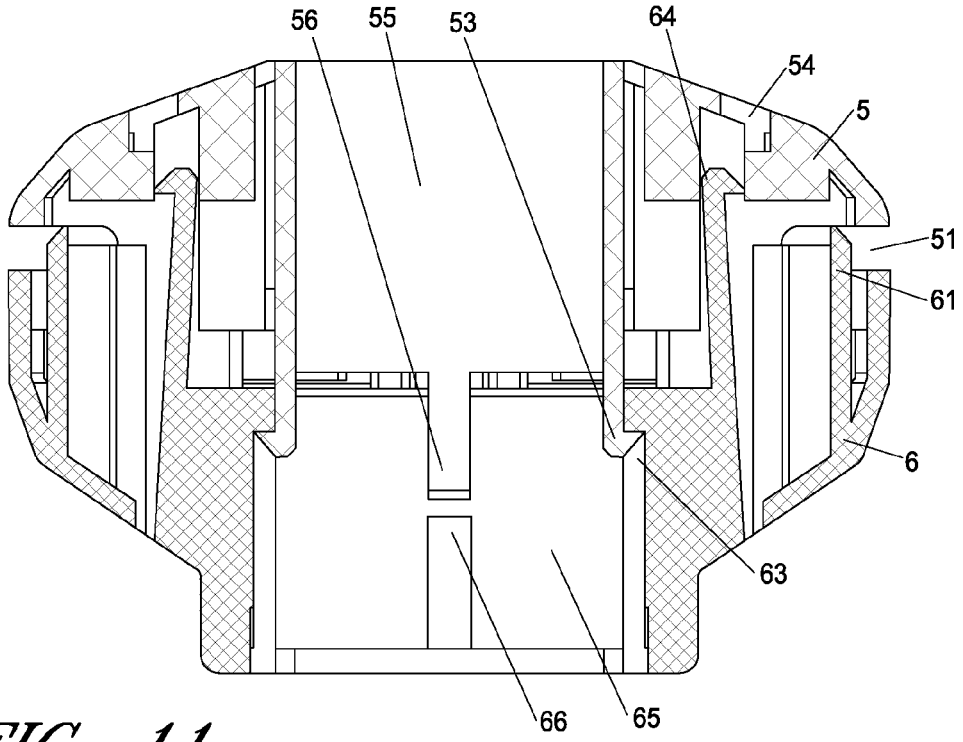
FIG. 11 is a schematic sectional view taken through section plane G-G in FIG. 8.

The quantity of first lower runner inverted fastening units 53 and first lower runner inverted grooves 63 and their installation method can be arbitrarily defined. Preferably, there should be a plurality, e.g., at least two, of the first lower runner inverted fastening units 53. The first lower runner inverted fastening units 53 may be symmetrical with respect to the axis of the corresponding lower runner cover 5 There should be a plurality, e.g., at least two, of the first lower runner inverted grooves 63. The first lower runner inverted grooves 63 can be symmetrical with respect to the axis of the corresponding lower runner base 6. With reference to FIGS. 9A, 9B and 11, in a specific embodiment of this invention, there is a plurality, e.g., two of the first lower runner inverted fastening units 53 and the first lower runner Inverted Grooves 63.

Figure 10A:
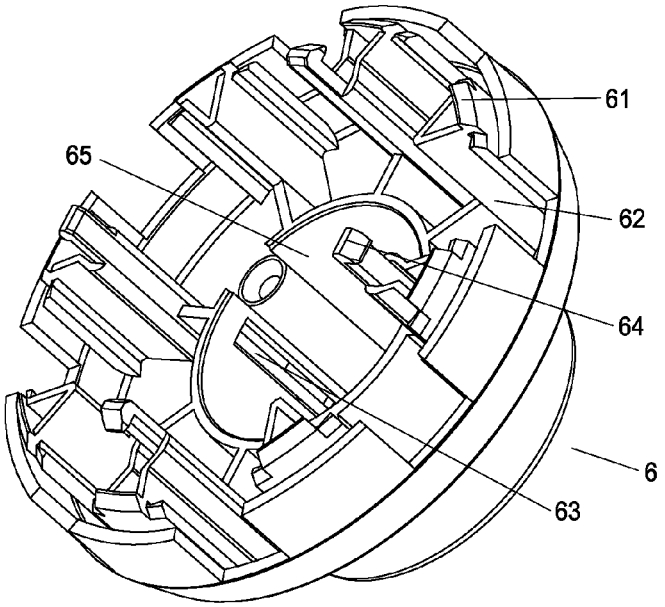
FIG. 10A is a schematic perspective view of a specific embodiment of the lower runner base shown in FIG. 8.
Figure 10B:
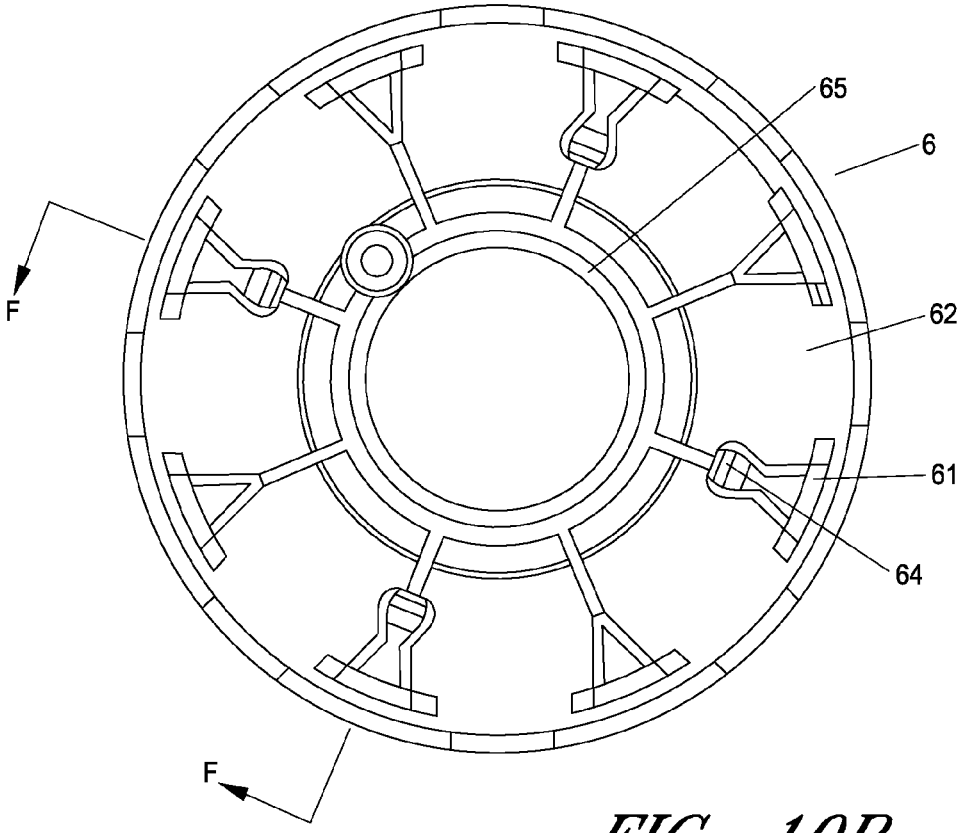
FIG. 10B is a schematic top view of a specific embodiment of the lower runner cover shown in FIG. 8.
Figure 10C:
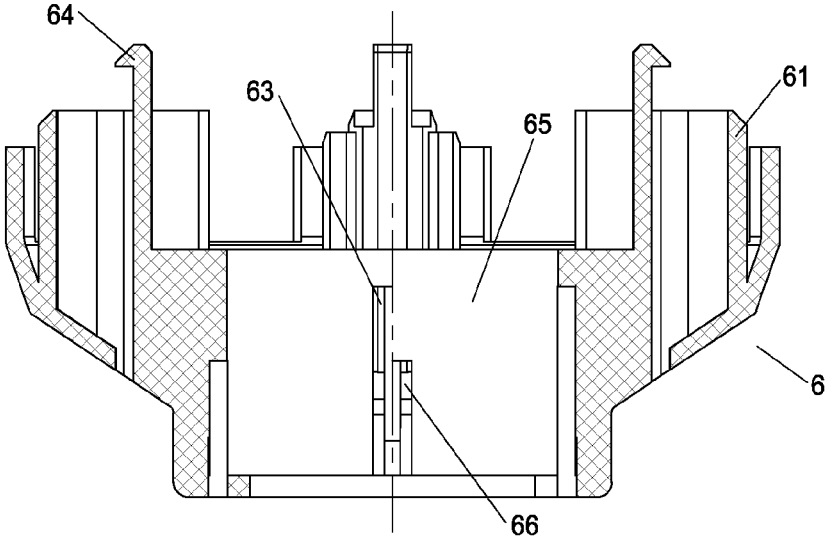
FIG. 10C is a schematic sectional view taken through section plane F-F in FIG. 10B.

The quantity of the second lower runner inverted fastening units 64) and the second lower runner inverted grooves 54 and their installation method can be arbitrarily defined. Preferably, there is a plurality, e.g., at least two of the second lower runner inverted grooves 54. The second lower runner inverted grooves 54 may be symmetrical with respect to the axis of the corresponding lower runner cover 5. There should be a plurality, e.g., at least two of the second lower runner inverted fastening units 64. The second lower runner inverted fastening units 64 may be symmetrical with respect to the axis of the said corresponding lower runner base 6. With reference to FIGS. 10A and 10B, in specific embodiments there is a plurality of, e.g., four of the second lower runner inverted fastening units 64 and the second lower runner Inverted Grooves 54.

In order to secure the connection, with reference to FIGS. 8-12, in the specific embodiment of this invention, the lower runner cover 5 has a first center hole 55. Third lower runner inverted fastening units 56 are located at the extension of the edge of the firstcenter hole 1 55. The first center hole 55 can be an aperture, e.g., a short cylindrical structure that facilitates sliding movement along an umbrella pole. The lower runner base 6 should have a second center hole 65. The second center hole 65 preferably has third lower runner inverted grooves 66. The second center hole 65 can be an aperture, e.g., a short cylindrical structure that facilitates sliding movement along an umbrella pole. At the fastening position 2, the third lower runner inverted fastening units 56 are fastened to the third lower runner inverted grooves 66.

Figure 12:
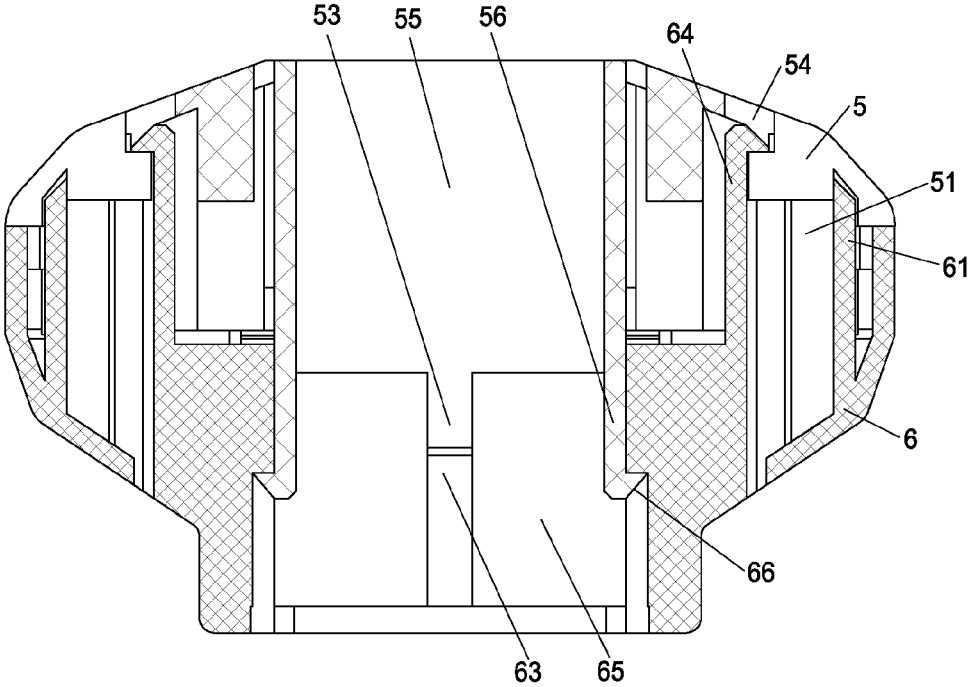
FIG. 12 is a schematic cross-sectional front view of a specific embodiment shown in FIG. 8 in a second fastening position.

The quantity of the third lower runner inverted fastening units 56 and the third lower runner inverted grooves 66 and their installation method can be arbitrarily defined. Preferably, there should be a plurality of, e.g., at least two of the third lower runner inverted fastening units 56. The third lower runner inverted fastening units 56 preferably are symmetrical with respect to the axis of the corresponding lower runner cover 5. There should be a plurality of, e.g., at least two of the third lower runner inverted grooves 66. The third lower runner inverted grooves preferably are symmetrical with respect to the axis of the said corresponding lower runner base 6. With reference to FIGS. 9A, 9B and 12, in specific embodiments, the quantity of the third lower runner inverted fastening units 56 and the third lower runner inverted grooves 66 is 2.

Figure 13:
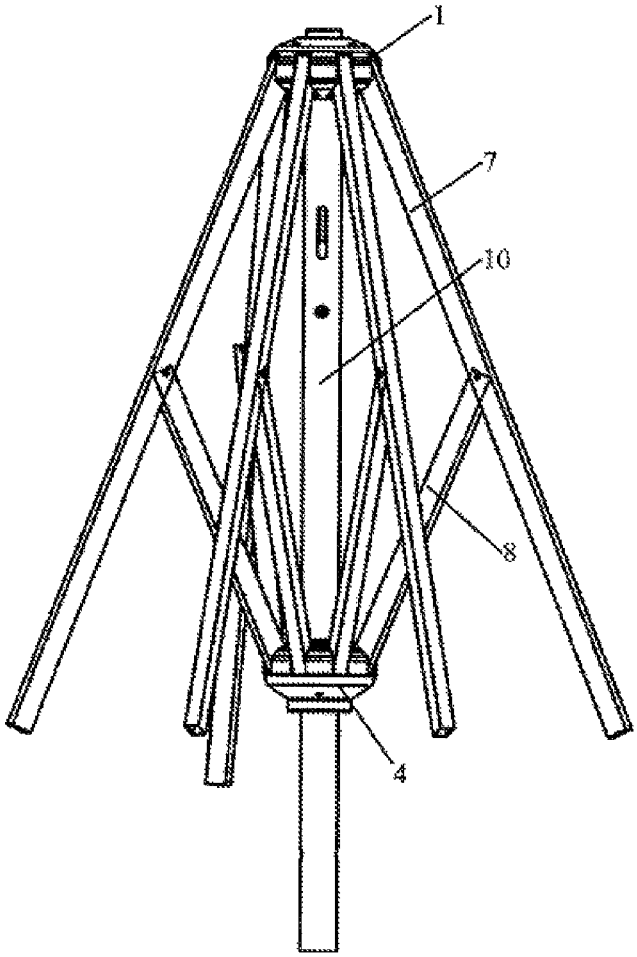
FIG. 13 is a schematic front view of a specific embodiment of the umbrella frame of this application.
Figure 14:
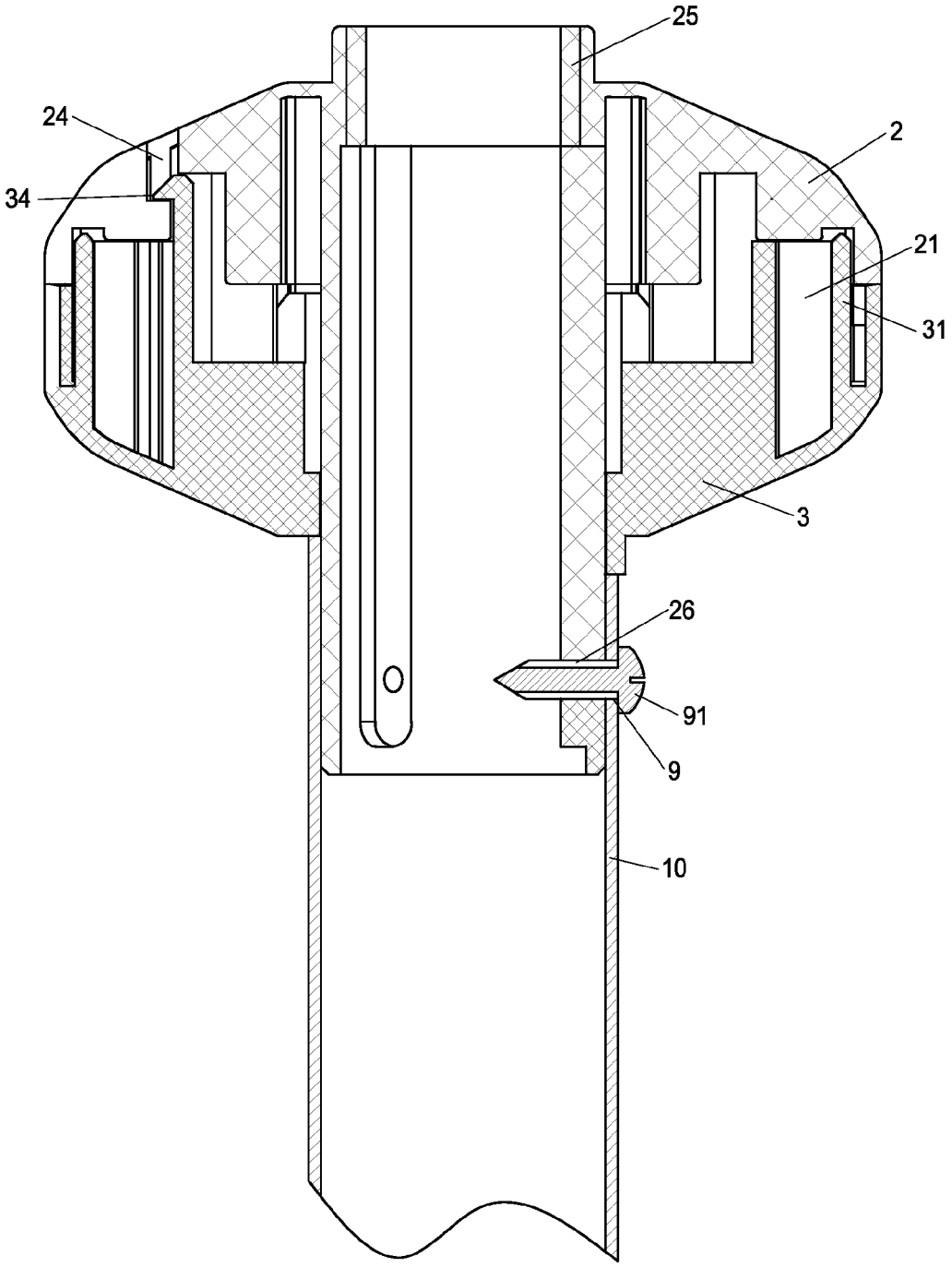
FIG. 14 is a schematic partial cross-sectional front view of an upper portion of the umbrella frame shown in FIG. 13.
Figure 15:
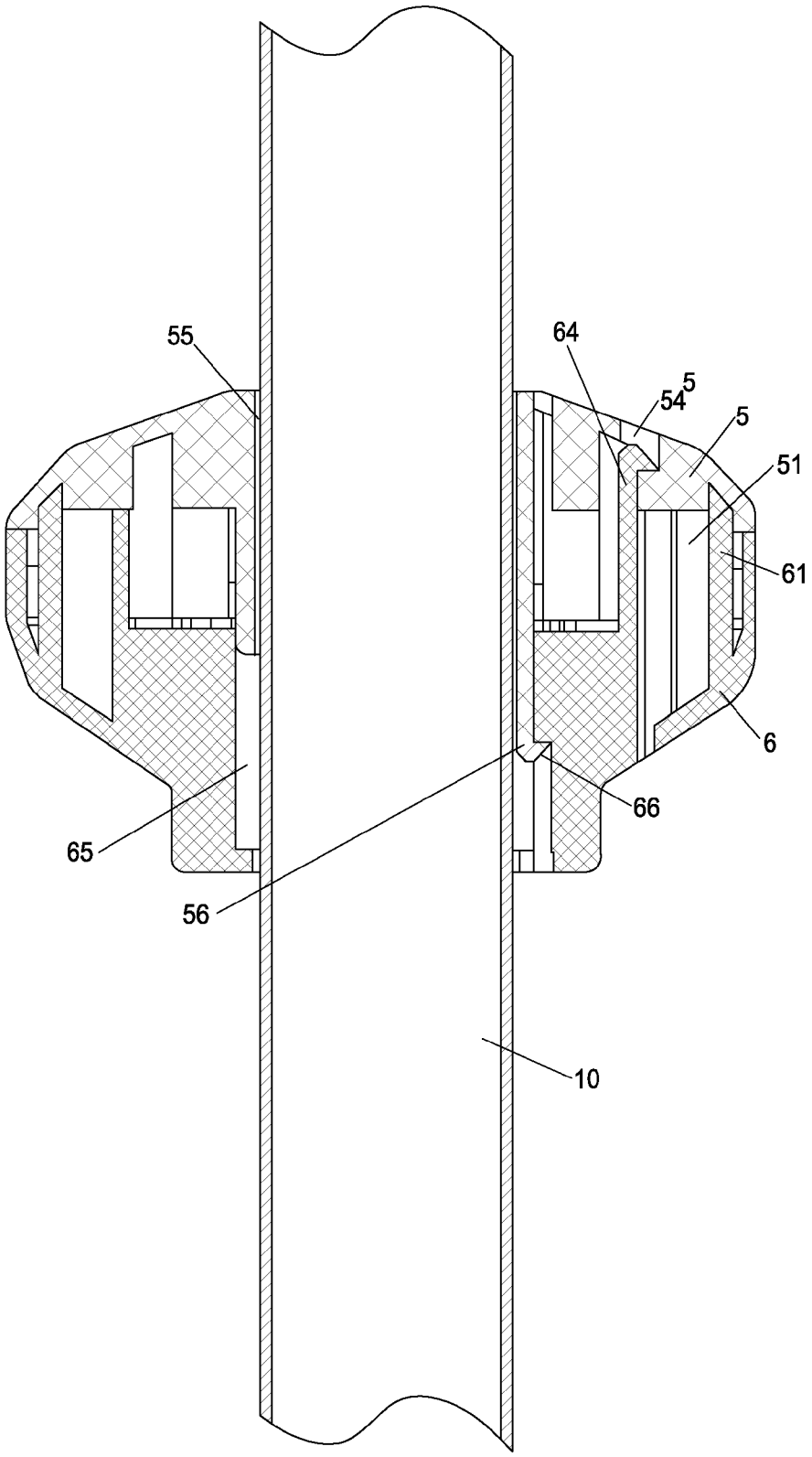
FIG. 15 is a schematic partial cross-sectional front view of a lower portion of the umbrella frame shown in FIG. 13.

With respect to FIGS. 13-15, an umbrella frame of this invention comprises first ribs 7, second ribs 8 and a shaft 10. One end of the first ribs 7 has first shaft pins (not illustrated). One end of the second ribs 8 has second shaft pins (not illustrated) and the other end of the second ribs 8 is swivel-connected to the center of the first ribs 7. The umbrella frame further comprises the upper hub 1 and the lower runner 4 of a quick frame assembly system. The upper hub 1 is installed on the said shaft 10. The upper runner cover 2 and the said upper runner base 3 mutually come together at position 2. One end of the first ribs 7 is situated in the first upper runner vertical grooves 22, and the two ends of the first shaft pins are situated in two adjacent upper runner rib hitching grooves 21. The first shaft pins are retained by the upper runner stop blocks 31 situated in the upper runner rib hitching grooves 21. The lower runner 4 is mounted and slides on the said shaft 10 and is situated below the upper hub 1. The lower runner cover 5 and the lower runner base 6 mutually come together at the position 2. One end of the second ribs 8 is situated in the first lower runner vertical grooves 52, and the two ends of the second shaft pins are situated in the two adjacent lower runner rib hitching grooves 51 and are retained by the lower runner stop blocks 61 situated in the lower runner rib hitching grooves 51.

Any suitable structure can be employed to install the upper hub 1 on the shaft 10. With reference to FIG. 14, in specific embodiments, the center of the upper runner cover 2 has a hollow sleeve 25. The upper runner base 3 is fitted into or over the hollow sleeve 25 and the hollow sleeve 25 is set into the shaft 10, and the upper runner base 3 is held up against the said shaft 10.

In order to ensure that the connection between the upper hub 1 and shaft 10 is reliable, the bottom section of the hollow sleeve 25 is provided with positioning holes 26, the shaft 10 is provided with fastener holes 9 and the positioning holes 26 and the fastener holes 9 are connected with fasteners 91. With reference to FIG. 14, in specific embodiments, the positioning holes 26 are threaded holes, the fastener holes 9 are screw holes and the fasteners 91 are screws. The screws are screwed into the said threaded holes and screw holes to achieve the connection.

Any suitable structure can be employed to install the lower runner 4 on the shaft 10. With reference to FIG. 15, in specific embodiments, the lower runner cover 5 has a first center hole 55 and the third lower runner inverted fastening units 56 are located at the extension of the edge of the center hole 1 (55). The lower runner base 6 should have a second center hole 65. The second center hole 65 has the third lower runner inverted grooves 66. The third lower runner inverted fastening units 56 are fastened to the third lower runner inverted grooves 66. The shaft 10 goes through the first center hole 55 and the second center hole 65 and is secured with the third lower runner inverted fastening unit 56. As no excess space between the third lower runner inverted fastening unit 56 and shaft 10, the lower runner will not fall off easily and thus achieve the effect of being immobilized.

Figure 4:
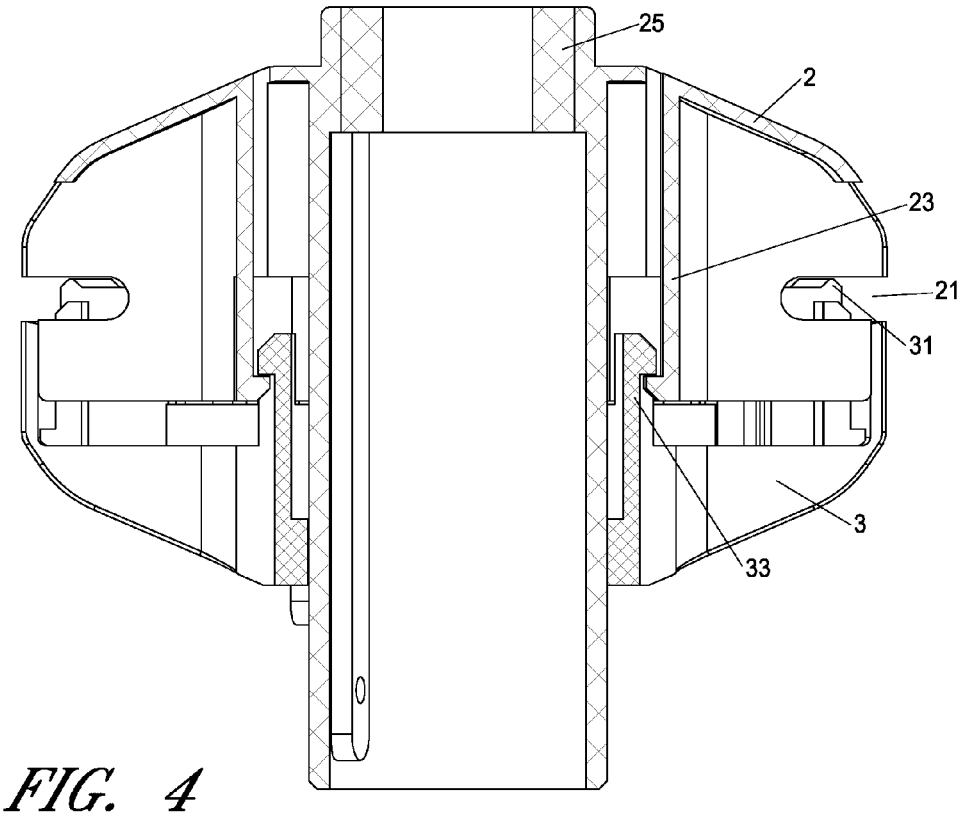
FIG. 4 is a schematic sectional view taken through section plane C-C in FIG. 1.
Figure 6:
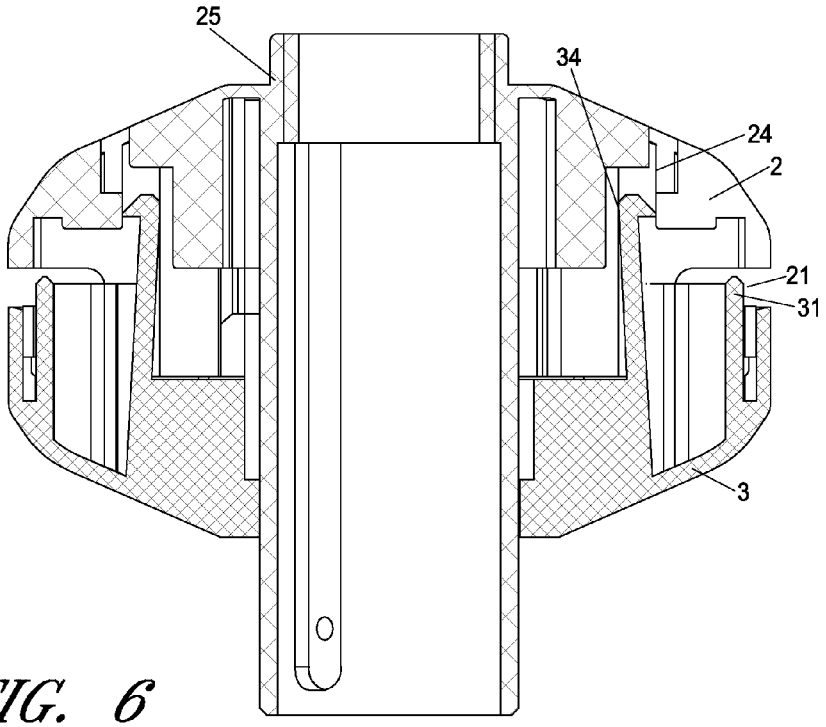
FIG. 6 is a schematic sectional view taken through section plane D-D in FIG. 5.
Figure 7:
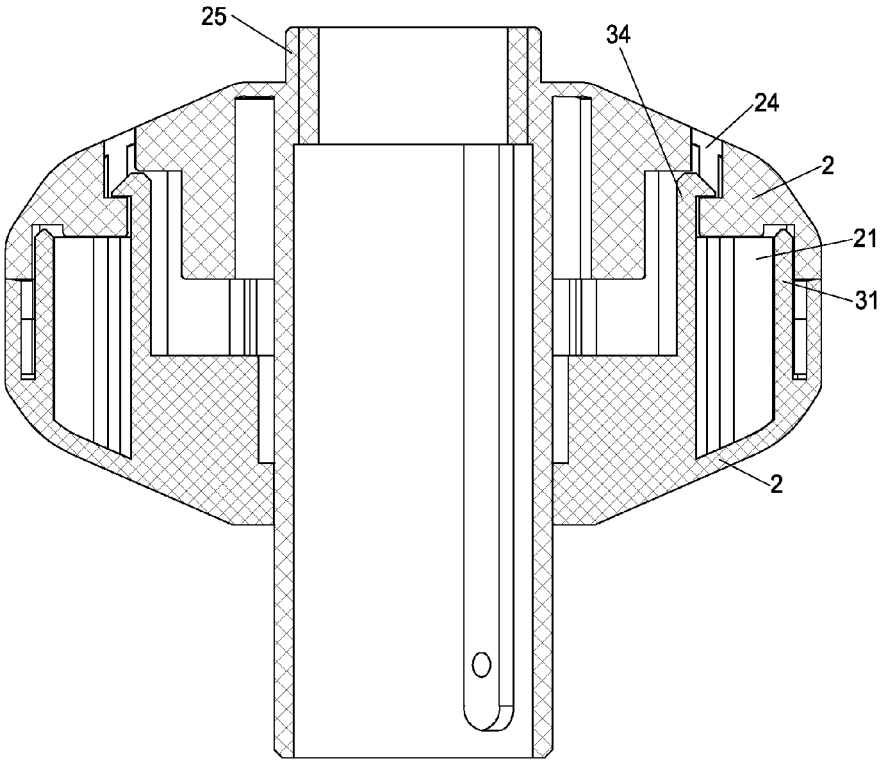
FIG. 7 is a schematic cross-sectional front view of a specific embodiment shown in FIG. 1 in a second fastening position.

When the upper hub cover 2 and the upper hub base 3 are fitted together, it will cause the upper hub 1 to be fastened at position 1 as illustrated in FIGS. 1, 4 and 6. One end of the first ribs 7 is situated in the first upper runner vertical groove 22, and the two ends of the first shaft pins are situated in the two adjacent upper runner rib hitching grooves 21, which then pushes the first ribs 7, causing the first shaft pins to press against the upper runner stop blocks 31. At least a portion of the said upper runner stop blocks 31 will be displace, e.g., out of the upper runner rib hitching grooves 21 as a result of the elastic deformation of the upper runner stop blocks 31 or the elastic deformation arising from the fastening of the first upper runner inverted fastening unit 23 to the first upper runner inverted groove 33. Upon such displacement the shaft pins 1 are able to enter the said upper runner rib hitching grooves 21. Thereafter, the upper runner stop blocks 31 return to their original position to immobilize or retain the shaft pins 1. The upper hub cover 2 and the upper hub base 3 are moved closer to each other until they become mutually fastened at position 2 as illustrated in FIGS. 7 and 14. The upper hub stop blocks 31 will move further into the upper runner rib hitching grooves 21 and in turn completely seal up or block all the upper hub rib hitching grooves 21 to firmly immobilize or retain shaft pins 1.

Figure 8:
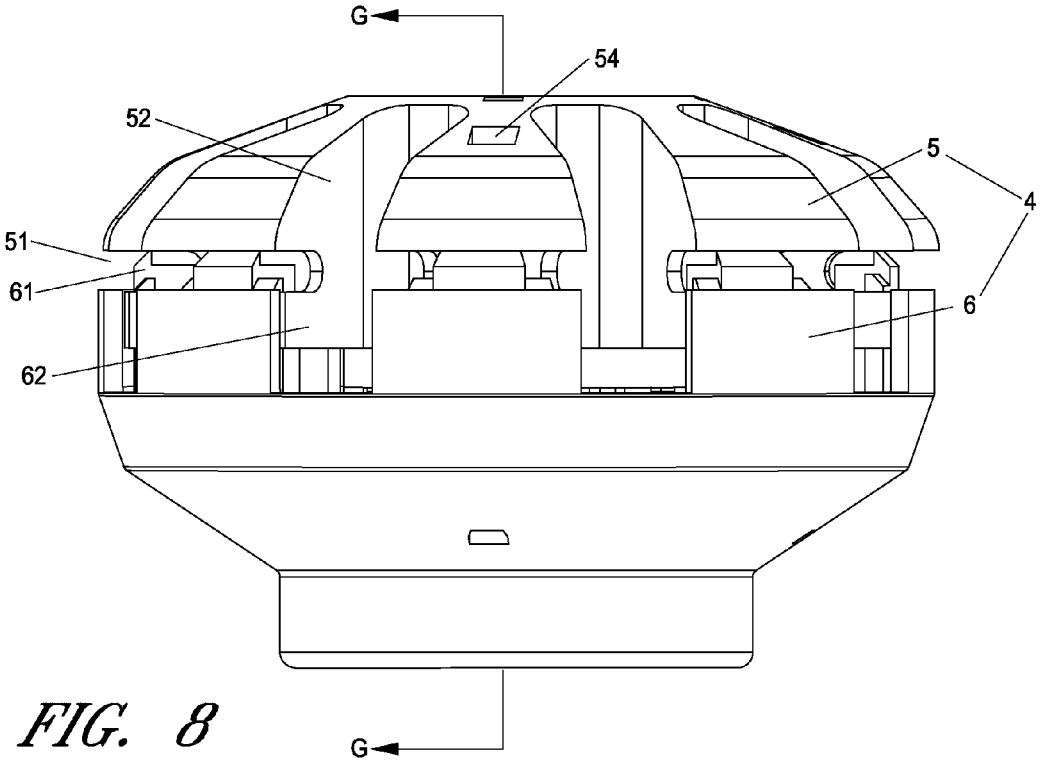
FIG. 8 is a schematic front view of a specific embodiment of the lower runner of this invention in a first fastening position.

Similarly, when the lower runner cover 5 and the said lower runner base 6 are fitted together, it will cause the lower runner 4 to fasten at position 1 as illustrated in FIGS. 8 and 11. One end of the second ribs 8 is situated in the first lower runner vertical groove 52, and the two ends of the shaft pins 2 are situated in the two adjacent lower runner rib hitching grooves 51, which then pushes the second ribs 8, causing the second shaft pins to press against the lower runner stop blocks 61. At least a portion of the said lower runner stop blocks 61 will be displaced, e.g., out of the lower runner rib hitching grooves 51 as a result of the elastic deformation of the lower runner stop blocks 61 or the elastic deformation arising from the fastening of the first lower runner inverted fastening unit 53 to the first lower runner inverted groove 63, and thus the shaft pins 2 are able to enter the said lower runner rib hitching grooves 51. Thereafter, the lower runner stop blocks 61 return to their original position to immobilize or retain the second shaft pins. The lower runner cover 5 and the lower runner base 6 move closer to each other until they become mutually fastened at position 2 as illustrated in FIGS. 12 and 15. The lower runner stop blocks 61 will move further into the lower runner rib hitching grooves 51 and in turn completely seal up or block all the lower runner rib hitching grooves 51 to firmly immobilize or retain shaft pins 2.

Therefore, no fixtures, tools or screws are required, only the runner covers and runner bases need to be securely fastened. The fastening units will be firmly fastened and the umbrella ribs can be assembled upside down (horizontal assembly).

In summary, the upper and lower hubs of these embodiments are cleverly designed and structurally simple. In another embodiment, a quick frame assembly method is provided. FIGS. 6 and 7 illustrate parts of a method related to an upper hub for an umbrella. A base 3 or lower portion is coupled with a cover 2 or upper portion of the hub. The hub has a groove 22 for ribs to move in during umbrella operation. The hub has transverse grooves 51 for receiving and retaining pins or other transverse members of an umbrella rib. Projections that may be flat members, referred to herein as stop blocks 31, are retention structures that are disposed on the base 3 but can also or alternatively be disposed on the cover 2. The retention structures extend into the transverse grooves 51 in a first assembly position (as in FIG. 6). One end of each rib of a plurality of ribs is inserted into the grooves 22 and ends of transverse members of the ribs into the transverse grooves 51. In one embodiment, the retention structures 31 are flexible so that when the shaft pins are pressed against them, the retention structures 31 are deflected. The deflection of the retention structures 31 permits the transverse members to be disposed in the transverse grooves. The position can be between the retention structures 31 and a central axis of the hub, e.g., passing through the centre of the sleeve 25. Relative movement is provided between the cover 2 and the base 3 to move the cover and base in to engagement (as in FIG. 7). The cover 2 and base 3 of the hub in this position prevent deflection of the retention structures 31. Deflection is prevented in the FIG. 7 position because the retention structures 31 are received in a recess that provides a rigid wall on both sides of the free end of the retention structures 31. These rigid walls hold the free end of the retention structures 31 so that the retention structures 31 will not deflect when the umbrella rib is loaded in normal use in a manner that permits the rib to be dislodged from the hub. There may be some deflection of course, but not sufficient of permit the free end of the retention structures 31 to come free of the rigid structures into which it is received.

Various figures show hook-like projections, which may be referred to as "fastening units" and corresponding grooves or inverted grooves, which have surfaces for engaging the hook-like members. These sturtures define first and second positions in a discrete and very secure way. These structures are discussed above in great detail.

No fixtures, tools or screws are required for the rib assembly. The assembly is quick, easy and flexible, and the ribs can either be assembled vertically or horizontally. It is also suitable for large-scale application.

In this specification, embodiments have been described with reference to specific implementations. However, many modifications and variations can clearly still be made without departing from the essence and scope of the inventions. Therefore, the Specifications and drawings should be considered as illustrative rather than restrictive.

What is claimed is:

1. An umbrella hub, comprising:

an inner portion and an outer periphery;

a base comprising a lower surface of the hub;

a cover comprising an upper surface of the hub;

a plurality of grooves in the outer periphery configured to receive umbrella ribs or struts;

a slot disposed in the outer periphery of the cover extending transverse to one of the grooves, the slot including an opening disposed adjacent to the outer periphery of the hub and an end opposite the opening disposed radially inwardly of the opening; and a retention member having a fixed end attached to the base of the hub and a free end disposed away from the fixed end to be insertable into the cover of the hub, such that when so inserted the retention member is disposed in the slot between the opening of the slot and the end of the slot opposite the opening;

wherein the slot permits a transverse pin coupled with the umbrella ribs or struts to be inserted into the slot from the outer periphery of the hub and where the retention member blocks the transverse pin such that inadvertent withdrawal of the transverse pin from the slot in which the retention member is disposed is prevented when the hub is fully assembled.

2. The umbrella hub of claim 1, wherein a fastening portion of at least one of the cover and the base is configured to receive a portion of the other of the cover and the base.

3. The umbrella hub of claim 2, wherein the cover further comprises a first fastening unit and a first fastening groove, and wherein the base further comprises a second fastening groove and a second fastening unit, and wherein in the first configuration of the hub the first fastening unit is fastened to the second fastening groove and in the second configuration the second fastening unit is fastened to the first fastening groove.

4. The umbrella hub of claim 2, wherein the cover further comprises a plurality of fastening units disposed substantially symmetrically about an axis of the cover and the base comprises a plurality of grooves disposed substantially symmetrically about an axis of the base.

5. The umbrella hub of claim 2, wherein the base further comprises a plurality of fastening units disposed substantially symmetrically about an axis of the base and the cover comprises a plurality of grooves disposed substantially symmetrically about an axis of the cover.

6. The umbrella hub of claim 2, wherein a center of the cover has a hollow sleeve disposed through the base.

7. The umbrella hub of claim 6, wherein a lower section of the said hollow sleeve comprises positioning holes.

8. The umbrella hub of claim 2, wherein the cover comprises a first central aperture and a fastening unit extending from a lower edge of the aperture, the base further comprising a second central aperture and a groove, and wherein in the second configuration the fastening unit is fastened to the groove.

9. The umbrella hub of claim 8, wherein the cover further comprises a plurality of fastening units disposed substantially symmetrically about the first central aperture and the base comprises a plurality of grooves disposed substantially symmetrically the second central aperture.

10. The umbrella hub of claim 1, wherein the retention structure is deflectable by the transverse pin to permit the transverse pin to move past the retention structure into the slot; and wherein the cover is moveable relative to the base to a position in which deflection of the retention members is prevented.

11. The umbrella hub of claim 10, wherein the cover comprises a fastening unit and the base comprises a groove and wherein, upon relative movement of the cover and the base toward each other, the fastening unit is engaged with the groove.

12. The umbrella hub of claim 11, wherein the fastening unit comprises a deflectable cantilever member.

13. An umbrella hub, comprising:

a hub body comprising a cover and a base, the cover and the base meeting at an interface, the hub body comprising a central axis extending therethrough;

a cavity disposed in the hub body;

a retention member disposed adjacent to the cavity and affixed to one of the cover and the base;

a first configuration in which the cover and the base of the hub body are secured to prevent the cover and the base from being disengaged and the retention member is at a first position within the hub providing an access path for advancing an umbrella rib into the hub from an opening at an outer periphery of the hub body; and a second configuration in which the cover and the base of the hub body are secured to prevent the cover and the base from being disengaged and the retention member is at a second position within the hub body disposed across the interface and into the other of the cover and the base to which the retention member is not affixed, the retention member when so disposed blocking the access path to prevent removing the umbrella rib from the hub;

wherein the second configuration is achieved from the first configuration through a substantially linear movement of the cover relative to the base along a direction parallel to the central axis and wherein the second configuration is achieved from the first configuration without the need for a rotation of the cover relative to the base.

14. The umbrella hub of claim 13, wherein the hub body comprises a projection of the base being disposed above a surface of the cover in the first configuration.

15. The umbrella hub of claim 14, wherein the retention member projects upward to a free end from the base, the free end being spaced from the cover in the first configuration and engaged with the cover in the second configuration.

16. An umbrella hub, comprising:

a hub body comprising a cover and a base, the cover and the base meeting at an interface, the hub body comprising a central axis extending therethrough;

a cavity disposed in the hub body;

a retention member disposed adjacent to the cavity and affixed to one of the cover and the base;

a first configuration in which the cover and the base of the hub body are secured to prevent the cover and the base from being disengaged and the retention member is at a first position within the hub providing an access path for advancing an umbrella rib into the hub from an opening at an outer periphery of the hub body; and a second configuration in which the cover and the base of the hub body are secured to prevent the cover and the base from being disengaged and the retention member is at a second position within the hub body disposed across the interface and into the other of the cover and the base to which the retention member is not affixed, the retention member when so disposed blocking the access path to prevent removing the umbrella rib from the hub;

wherein the hub body comprises a projection of one of the cover and the base being disposed above a surface of the other of the cover and the base in the first configuration; and wherein the projection comprises a cantilevered member having a hook disposed at an end thereof to be positioned over the surface.

17. The umbrella hub of claim 16, wherein the projection is in the base and comprises a first projection and further comprising a second projection extending downward from the cover into engagement with a second surface of the base.

18. The umbrella hub of claim 17, wherein the second projection includes a hook member configured to be disposed under the second surface of the base.

19. The umbrella hub of claim 17, wherein the second projection is engaged with the base in the first configuration and the first projection is engaged with the cover in the second configuration.

20. An umbrella hub, comprising:

a hub body having an outer periphery;

a cavity disposed in the hub body and configured to retain pivot members of umbrella ribs;

a retention member disposed radially outward of the cavity and between the cavity and the outer periphery of the hub body the retention member having a free end;

a first configuration in which a cover and a base of the hub body are secured to prevent the cover and the base from being disengaged by disposing a first portion of one of the cover and the base over a second portion of the other of the cover and the base such that the first portion blocks removal of the cover from the base and the retention member is at a first position within the hub providing an access path for advancing an umbrella rib into the cavity from an opening at an outer periphery of the hub body; and a second configuration in which the cover and the base of the hub body are secured to prevent the cover and the base from being disengaged and in which the retention member is at a second position within the hub body blocking the access path to prevent removing the umbrella rib from the hub, the free end of the retention member being received within a recess in the hub body.

21. The umbrella hub of claim 20, wherein the first portion comprises a first fastening unit having a first end affixed to one of the cover and the base and a second end comprising a first hook disposed away from the cover or the base to which the first end of the first fastening unit is affixed;

a second fastening unit having a first end affixed to one of the cover and the base and a second end comprising a second hook disposed away from the cover or the base to which the first end of the second fastening unit is affixed;

wherein the first configuration is provided by disposing the first hook over the second portion, the second portion comprising a first surface of the other of the cover or the base to which the first fastening unit is not affixed to prevent the cover and the base from being disengaged; and wherein the second configuration is provided by disposing the second hook over a second surface of the other of the cover or the base to which the second hook is not affixed to prevent the cover and the base from being disengaged.

* * * * *